United States Patent [19]

Donine

[11] Patent Number: 4,940,255

[45] Date of Patent: Jul. 10, 1990

[54] METHOD AND APPARATUS FOR SUPPORTING SKIS ON A SKI LIFT

[76] Inventor: Michael T. Donine, P.O. Box 6836, Oxnard, Calif. 93030

[21] Appl. No.: 313,167

[22] Filed: Feb. 16, 1989

[51] Int. Cl.[5] ..... A63C 11/22

[52] U.S. Cl. ..... 280/809; 280/819

[58] Field of Search ..... 280/809, 819, 814, 637

[56] References Cited

U.S. PATENT DOCUMENTS

| | | | |
|---|---|---|---|
| 4,165,887 | 8/1979 | Bunn, Jr. | 280/637 |
| 4,299,409 | 11/1981 | Gedicks | 280/819 |
| 4,341,400 | 7/1982 | Morgan | 280/819 |
| 4,358,138 | 11/1982 | Laughlin et al. | 280/819 |
| 4,589,681 | 5/1986 | Erickson | 280/819 |

*Primary Examiner*—Richard A. Bertsch

*Attorney, Agent, or Firm*—Herbert C. Schulze

[57] ABSTRACT

A method, and apparatus for practicing said method, for easing the strain on skier's legs while riding on ski lift chairs, wherein the method involves support means fastened about the waist of a skier, extending over the edge of the ski lift chair so as to support a load, and under the skier's skis so as to relieve the pressure of the leading edge of the ski lift chair against the skier's legs and to relieve the weight of the skis and ski boots from the skier's legs. The method includes utilizing support members extending outwardly from support means bearing against the leading edge of a ski lift chair and supported by body encircling harness, with pouch means to carry the support means when not being used.

6 Claims, 4 Drawing Sheets

34
38
32
42
38
35
36
30
40
40
20
46

48
50
47
56
54
52
48
54
58
44
6
56
54
101
100
50
58
102
54
6
48
58
52
54
56
54
101
100
50
102

METHOD AND APPARATUS FOR SUPPORTING SKIS ON A SKI LIFT

BACKGROUND OF THE INVENTION

I. Field of the Invention

This invention is in the general field of skiing. The invention is even more particularly directed to a method and apparatus for resting the legs of a skier while riding on a ski lift. The invention is even more particularly directed to such a method wherein a pair of skis, ski boots, and skiers legs are supported by a pair of ski rest members carried by a carrying means fastened about the body of a skier extending between the skiers legs and bearing against the leading edge of a ski lift chair, causing the major weight and load to be handled by the bearing against the leading edge of the ski lift chair.

II. Description of the Prior Art

The problem of supporting the heavy weight upon a skiers legs and knees of skis and ski boots upon a skier's feet while traveling in a ski lift chair have been known for some period of time.

The prior art of attempts to solve this problem have consisted of devices attached to ski lift chairs which provide some type of support bar in front of the chair or devices or means of supporting the legs by use of skier's poles. Such devices, while having been of some value, have not been satisfactory and do not completely solve the problems encountered. There has been no prior art to my knowledge of a body encircling support means carrying ski supports which is safe and usable by skiers of any level of competence, and which support the leg, ski, and boot weight by pressure against the leading edge of the ski lift chair while the skier is seated upon the ski lift chair.

SUMMARY OF THE INVENTION

The sport of alpine, or down hill, skiing is a rapidly growing and widely utilized recreation and competition activity.

In alpine skiing it is customary to ride a lift of some sort from a base area to a higher elevation from which the skiing, down hill, may be readily accomplished.

The most widely used lifts are referred to as "chair lifts" and consist of a series of seats, generally with backs, upon which one, two, three, or even four skiers may ride simultaneously from the base area to a higher elevation. The skier will ski off of the lift at an area where the skis will reach the snow, and there will generally be a downward slope so the skier can ski clear of the moving chair.

As is known to those who ski, the skis, and the boots used, comprise a very heavy weight, frequently in the neighborhood of fifty pounds. This weight, combined with the configuration of most chair lifts means that the legs are pulled hard just above the knee against the upper leg near the knee on the underside. This causes an interruption of appropriate circulation and also straining of certain muscles, tendons, and the like. Not only are the loss of circulation and the straining harmful and tiring, but the loss of circulation and muscle and tendon strain and cold temperatures result in increased adverse effect of the cold temperatures on the feet.

It has long been desired to provide a method and means for relieving this pressure against the underside of the upper legs when seated and to relieve the downward pressure on the legs. Certain efforts have been made to solve this problem, but without completely satisfactory results.

I have now conceived and developed a method and an apparatus for practicing the method, wherein a support apparatus having rests for both the left and the right ski is attached around the waist of the skier and bears against the front edge of the ski lift chair in such manner as to relieve the pressure against the legs and other pressures from the weight of the skis. The relieved weight is transferred in the method and apparatus of this invention so as to bear principally upon the leading edge of the ski lift chair and thus cause the chair itself to be a major factor in carrying the weight now transferred.

I accomplished the desired end by providing a belt like harness which goes around the waist of the skier and which has a pouch on the front with the belt entering the pouch and a cooperative strap or the like attached to the belt and supporting, at an adjustable height, a double sided bar, or the like, upon which the skis may be rested.

In modifications, an additional pouch may be carried at the back of the same belt as may be desired by some skiers for carrying accessories, food, and the like. Further modifications include means to raise the ski support members, to adjust the length of the ski support members from the body of the user and the seat of the ski lift, and to provide for easy release and withdrawal of the ski support members when ready to leave a ski lift chair.

It is an object of this invention to provide a method and apparatus for supporting the weight of a skier's legs, skis and boots when traveling in a ski lift chair;

Another object of this invention is to provide a support for relieving the weight of the skier's legs, skis, boots and the like so as to not press against the underside of the upper leg when seated;

Another object of this invention is to provide such a method and apparatus as described wherein the device may be carried without interfering with the skier's other movements;

Another object of this invention is to provide such a method and apparatus as described wherein the major weight is carried by pressure on the leading edge of the chair lift seat.

The foregoing and other objects and advantages of this invention will become apparent to those skilled in the art upon reading the description of a preferred embodiment which follows in conjunction with a review of the appended drawings.

DESCRIPTION OF A PREFERRED EMBODIMENT

Figure 1:
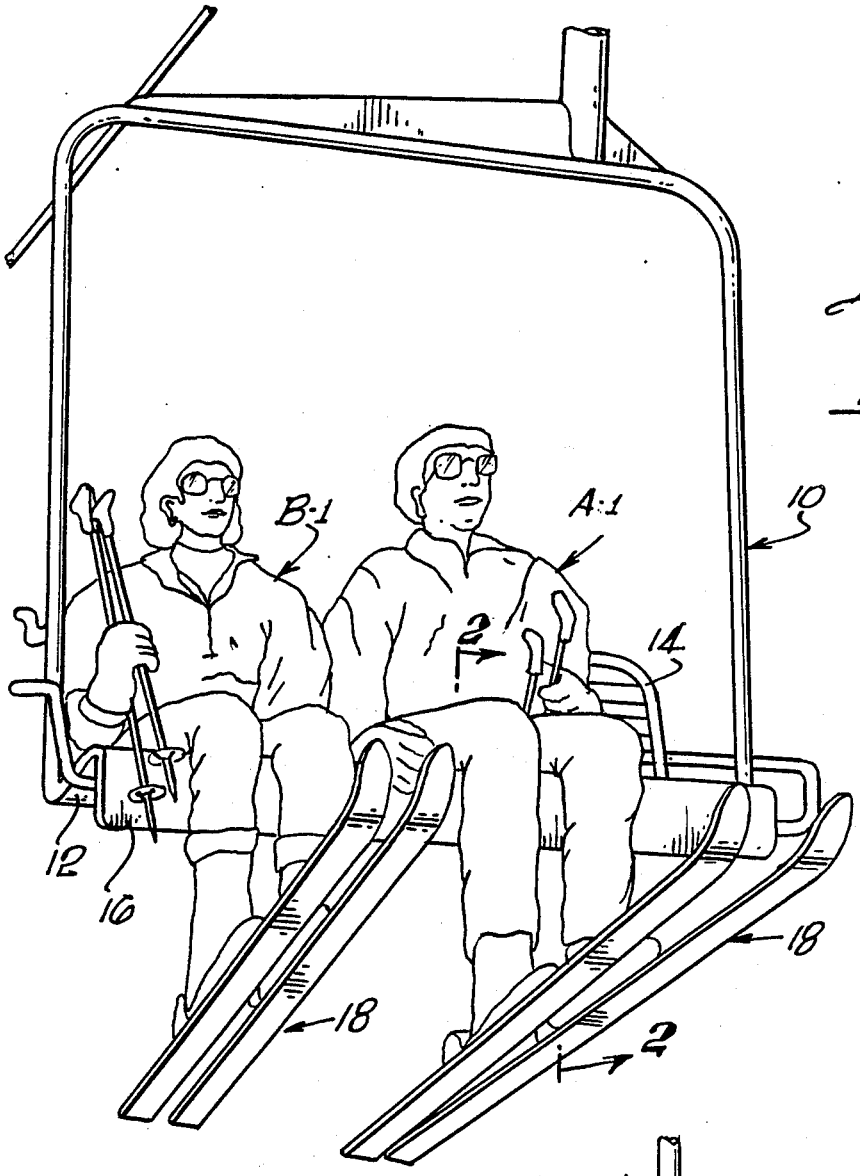
FIG. 1. PRIOR ART
FIG. 1 is a perspective of skiers riding on a ski lift chair, without using this invention, and indicating the problem to be solved.
Figure 2:
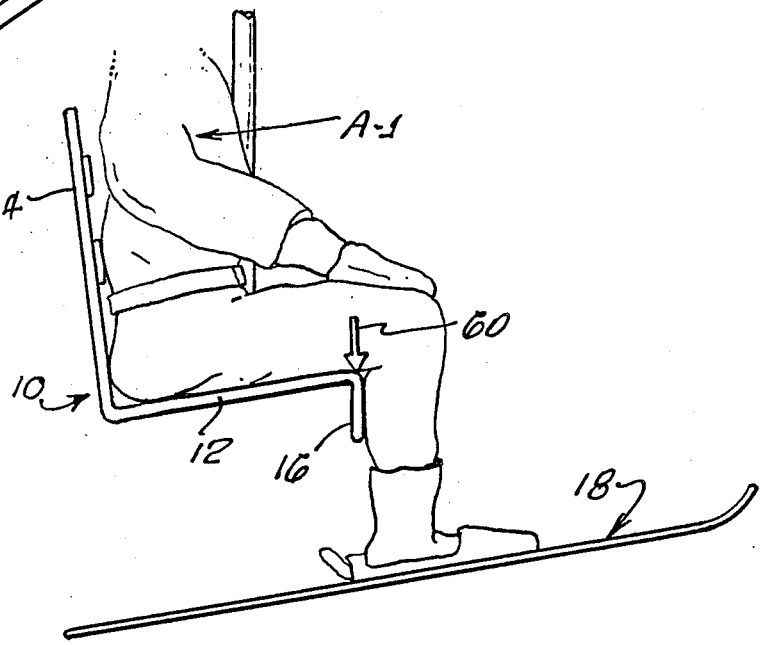
FIG. 2. PRIOR ART
FIG. 2 is a partially broken away right side elevation on 2—2 of FIG. 1.

FIGS. 1 and 2 illustrate the generally accepted situation of skiers riding on a ski lift chair. A pair of skiers A and B are riding on a ski lift chair generally 10 having a seat 12, a back 14 and a leading edge 16. Each of the skiers is shown to be wearing a pair of customary skis 18. It will be noted at the point 60, shown best in FIG. 2, that the skiers leg is pulled downward against the leading edge of the seat and against the seat itself with considerable force, due to the weight of the skis and ski boots as well as the mere weight of the skier's legs. This causes a loss of circulation and discomfort as well as a tiring effect and considerable strain on the muscles and tendons, together with the increased cold to the feet due to decreased circulation.

Figure 3:
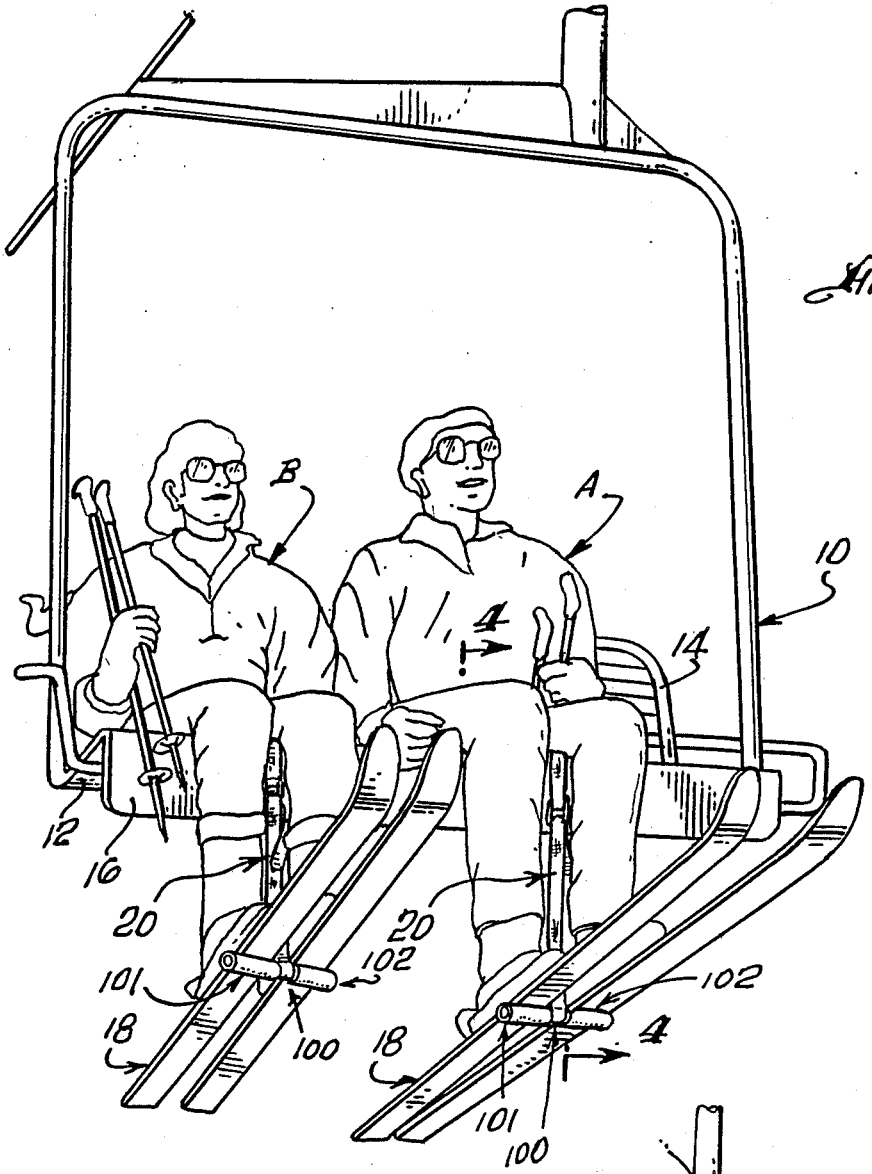
FIG. 3 is a perspective of skiers as in FIG. 1 but wherein they are utilizing a device of this invention to practice the method of this invention.
Figure 4:
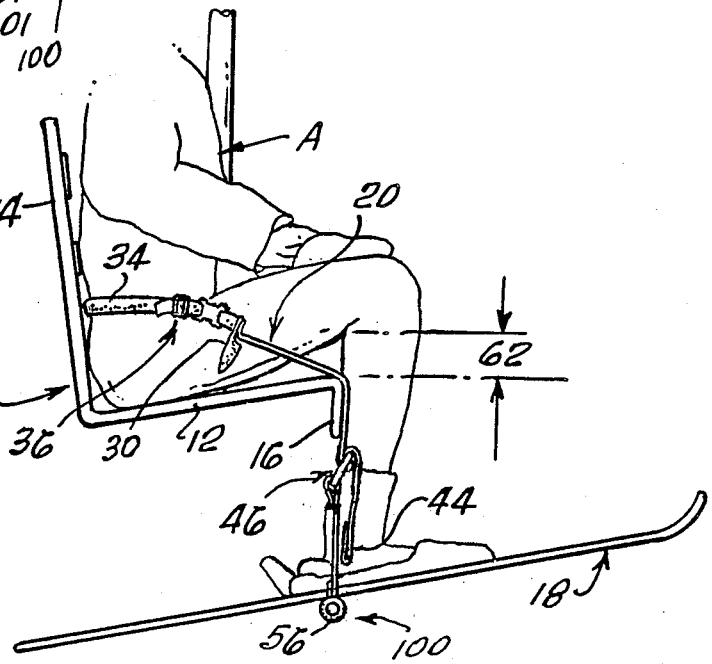
FIG. 4 is a partially broken away right side elevation on 4—4 of FIG. 3.

FIGS. 3 and 4 show the same skiers, and the same views except that they are now using the method and apparatus of this invention. The apparatus as shown comprises the footrest generally 100 carried by strap 40-48, and including two ski rest members 101 and 102 as illustrated. The strap 40-48 is attached to a belt 34 by loop 42 which belt encircles the body of the skier A and pulls downward to bear against the leading edge of the ski lift chair thus placing the force and weight which formerly was carried beneath the knee of the skier. It will be noted that the leg is slightly lifted as at 62, thus relieving the pressure against the blood vessels, tendons, muscles and the like.

Figures 5, 6, 7:
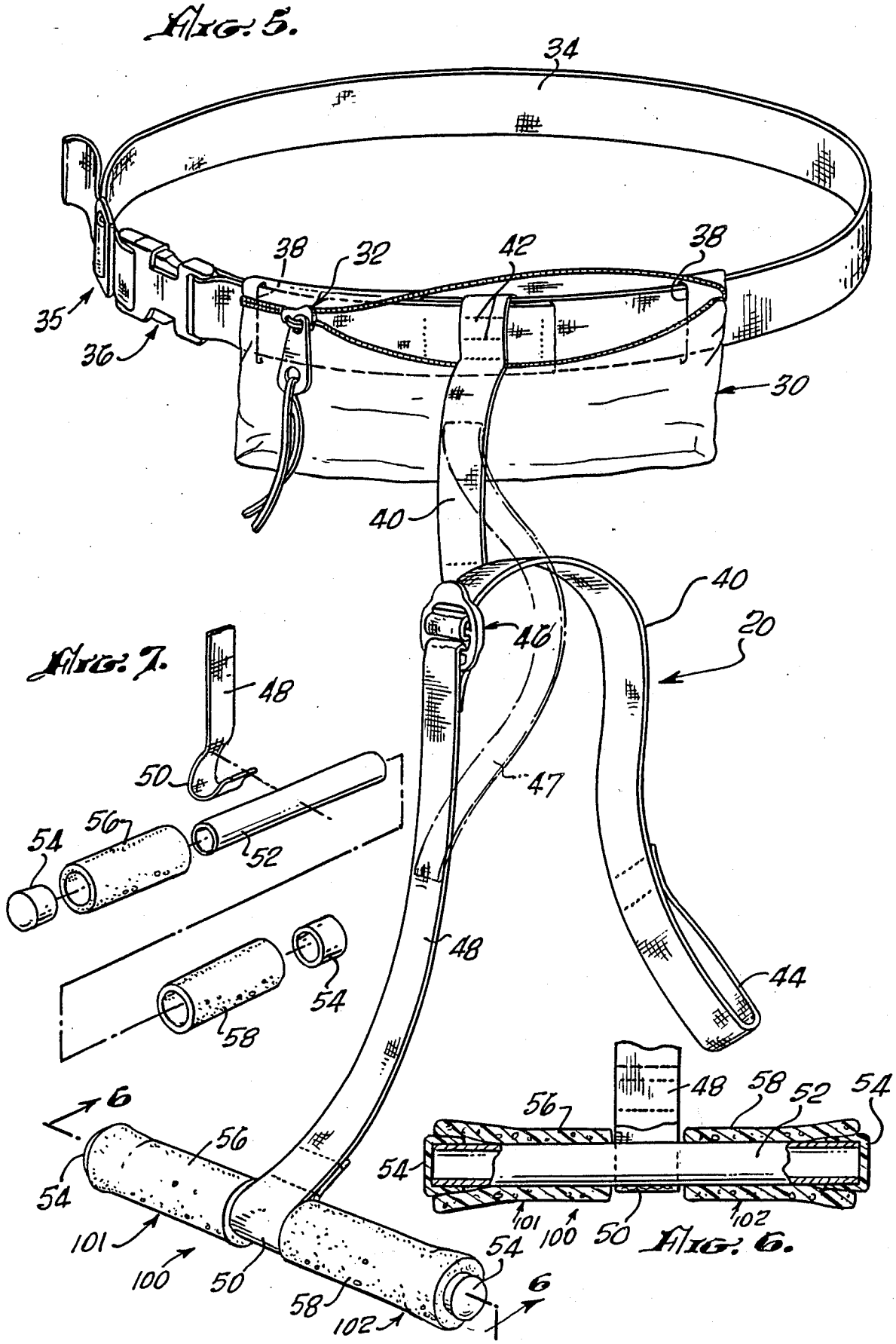
FIG. 5 is a perspective of a device to practice the method of this invention.
FIG. 6 is a partial section on 6—6 of FIG. 5.
FIG. 7 is an exploded view of the elements shown in FIG. 6.
Figure 8:
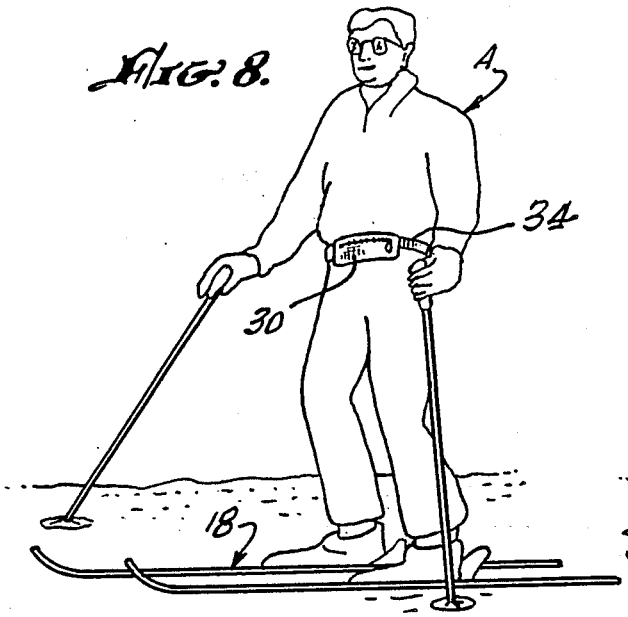
FIG. 8 is a perspective of a skier wearing a device of this invention, but not in use.
Figure 9:
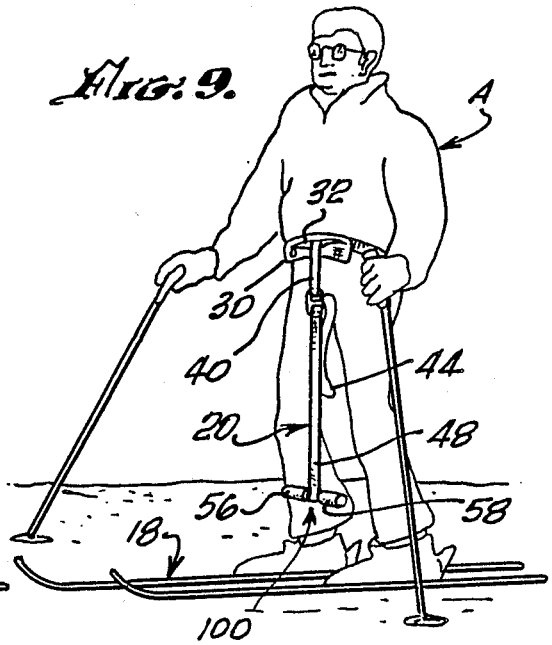
FIG. 9 is a perspective of the skier of FIG. 8 but with the device out of its carrying pouch and ready for use, or ready to be stowed in its carrying pouch.

FIGS. 5, 6 and 7 show all of the essential elements of the most preferred apparatus to practice the method of this invention. It will be noted that the belt 34 is adjusted in a manner known to those skilled in the art at 35 so it can fit snugly about the waist of the user. The belt 34 is buckled with a customary buckle 36, known to those skilled in the art. A pouch 30 having a zippered closure at 32 and belt opening at 38 is provided on the front of the belt 34. When not being used, the straps 40-48 with the adjustment member 46, together with the foot rest generally 100 will all be stowed within the pouch and the pouch will be closed. The appearance of the skier with such a situation is indicated in FIG. 8. A relatively weak elastic 47 may be fastened to the strap 40 and to the strap 48 approximately as shown, and, if so used, will pull the ski rest generally 100 upward by the amount of the elasticity in the elastic strap. Thus, when the skis are released from the ski rest as is hereinafter described the ski rest will not be dangling down about the knees or below as shown in FIG. 9, but will be carried upwardly above the knees.

The strap 48 terminates in a loop 50 fastened and held in place by sewing, rivets, clamps, or the like as will be known to those skilled in the art. The loop at 42 will likewise be sewn or otherwise fastened to provide adequate support, in a manner known to those skilled in the art.

The foot rest 100 comprises a tubular member 52 within the loop 50 and two foot rest members 56 and 58, preferably of foam rubber or the like so as to not scratch the skis when the skis rest upon them. The end caps 54 are tapered as indicated so as to hold the members 56 and 58 in place upon the tubing 52 by the flared extension as illustrated. The caps 54 will be fastened in place by suitable adhesive or the like.

Figure 10:
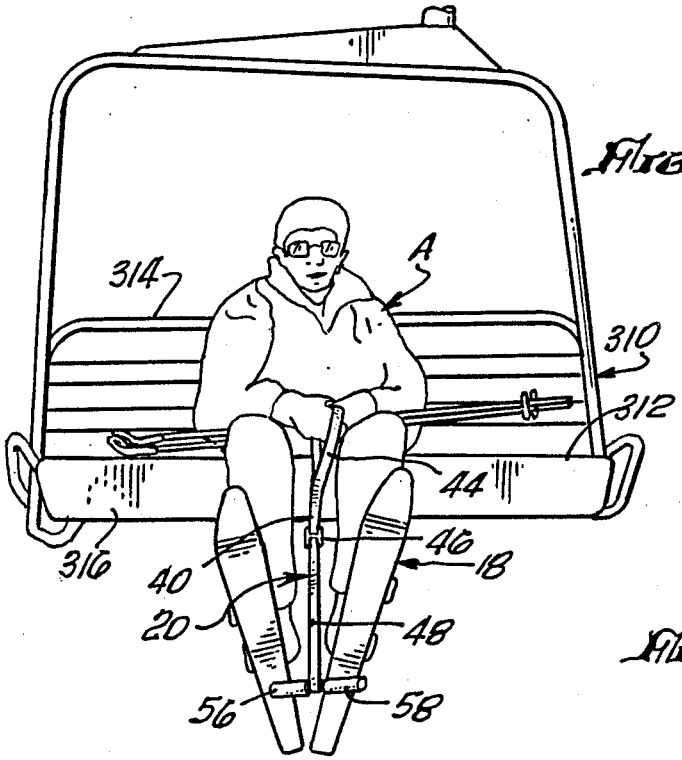
FIG. 10 is a front elevation of a skier on a ski lift utilizing the device and method of this invention and in the process of adjusting the length of the device.

Strap 48 will terminate at its upper end in a loop 44 which will provide an easy means to adjust the length of the overall strap 40-48 in use. A skier adjusting such a strap is shown in FIG. 10.

FIG. 8 shows a skier C upon skis 19 while he is skiing and wearing the belt 34 with the pouch 30 containing the items shown in FIGS. 5, 6 and 7. This will be the normal situation while actively skiing.

When preparing to get on a lift, or while on the lift, the contents of the pouch 30 will be released as indicated in FIG. 9 and the foot rest generally 100 will be hanging approximately as shown. This will, also, be the situation when the skier has left a ski lift. In the event the elastic strap 47 shown in FIG. 5 is utilized the ski rest generally 100 will be held at a higher elevation above the knees.

On the ski lift chair generally 310, a skier can adjust his ski rest device by pulling on the handle 44 and slipping the strap 40 through the adjustment buckle 46 to achieve the desired length. Thus, the weight of the skis, boots and legs of the skier will be transferred through the ski rest members 56 and 58 so that the skier's legs will elevate above the chair lift leading edge 312.

Figure 11:
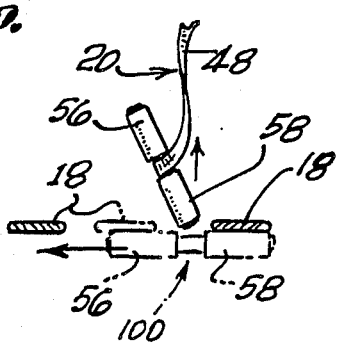
FIG. 11 is a schematic representation of the release of skis from the device of this invention when in use.

FIG. 11 illustrates the manner in which the skis are removed from the ski support elements 56 and 58. One ski 18 will merely slide off of its rest 56, and in so doing, the entire ski rest item 100 will flip up as indicated and the other ski will drop free.

Figure 12:
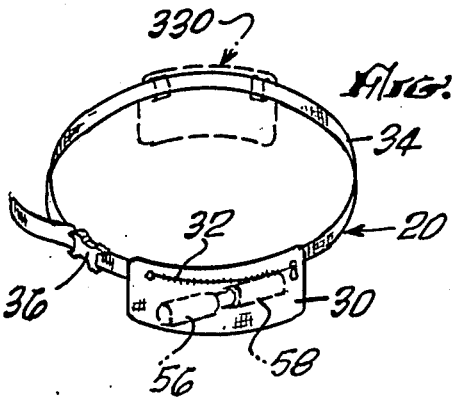
FIG. 12 is an alternate embodiment of a device to practice the method of this invention.

FIG. 12 shows an alternate embodiment of this invention in which an accessory pouch 330 is added to the rear of the belt 34 and can carry certain accessories for the skier as desired.

Figure 13:
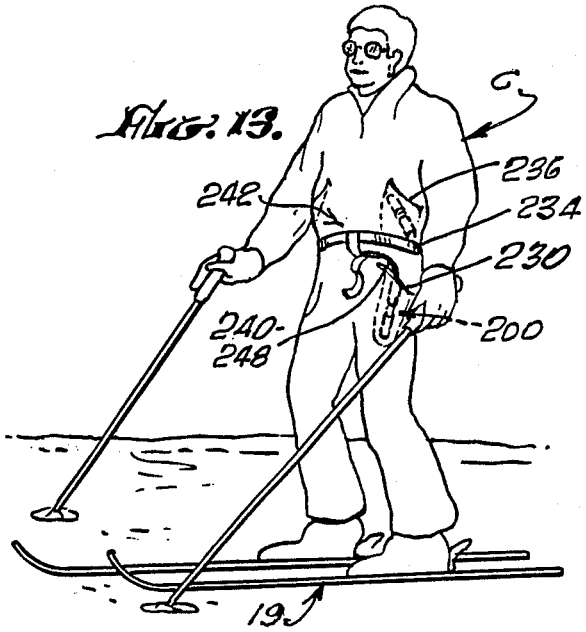
FIG. 13 shows a skier with another embodiment of this invention.

FIG. 13 shows an alternate embodiment of this invention, not considered as desirable as the embodiment heretofore shown and fully described, but nonetheless still something which might be used. In this view, a skier C is shown on a pair of skis 19 and wearing a belt 234. A strap arrangement 240-248 similar to the strap arrangement 40-48 is fastened about the belt 234 at 242 by an appropriate loop or the like. The ski rest generally 200 is carried by the strap 240-248 in a manner similar to that previously shown in detail but in this case there is no pouch corresponding to the pouch 30. Instead, the strap and the ski rest apparatus may be carried in a pocket 230 or a jacket pocket 236 or by some auxiliary holster or carrying bag (not shown).

It is to be understood that the embodiments of this invention shown and described are for purposes of illustration only and not for purposes of limitation.

I claim:

1. Apparatus suitable to be worn upon the body of a skier, said apparatus being for the purpose of providing a support for skis while a skier is riding upon a ski lift chair comprising in cooperative relationship: adjustable belt means suitable to encompass the waist of a skier; first pouch means carried by said adjustable belt means and having an openable closure; first connecting means fastened to said belt means in such manner as to be insertable in said pouch means; second connecting means adjustably connected to said first connecting means in such manner as to be insertable with said first connecting means in said pouch; support means for two skis removably fastened to said second connecting means and in such manner as to be insertable into said pouch with said first and second connecting means.

2. The apparatus of claim 1 wherein a second pouch for carrying auxiliary materials is removably connected to said belt means.

3. Apparatus to be worn by a skier and suitable to support the skier's skis when riding on a chair lift comprising: first belt means suitable to encompass the body of the skier including a length of flexible material, a buckle suitable to fasten two ends of said first belt means together; and adjustment means in cooperative relationship with said belt and buckle means in such manner as to enable adjustment of the size of said belt; pouch means removably and adjustably carried upon said first belt means; ski support means carried within said pouch and including, a first adjustable support connector means fastened to said first belt means; second support connecting means adjustably connected at a first end thereof to a second end of the first support connecting means; first ski support means fastened to a second end of said second support connecting means and comprising a first tubular member; a second tubular member encompassing a portion of said first tubular member, a third tubular member encompassing another portion of said first tubular member; a first tapered cap removably connected to a first end of said first tubular member and insertable thereon within a first end of said second tubular member in such manner that said second tubular member is expanded at its first end, and second cap means insertable over a second end of said first tubular member and within a first end of said third tubular member in such manner as to expand the same at said first end of said third tubular member.

4. The apparatus of claim 3 wherein a first auxiliary pouch is provided adjustably mounted upon said first belt means at a distance from said first pouch means.

5. The apparatus of claim 3 wherein said first connecting support means is connected at a first end to said first belt means and wherein loop means is provided upon the second end thereof, and wherein a length adjusting buckle is adjustably mounted intermediate the first and second ends thereof.

6. The method of safely relieving the weight of skis and the like and other skiing paraphernalia from the legs of a skier while riding upon a ski lift chair comprising: equipping a skier with first connecting means connected to his body comprising fastening a belt about the body of said skier; cooperatively connecting second connecting means to said first connecting means, said second connecting means depending from the body over the leading edge of a ski lift chair and between the legs of the skier riding the chair; first support means for supporting two skis, one on each side of said second connecting means, and carried by said second connecting means; installing a pouch suitable to contain said first support means and said second connecting means upon said belt; adjusting the length of said second connecting means so as to relieve the weight of the skis and other paraphernalia from the legs by means of its bearing against the leading edge of a ski lift chair; placing the skis upon said first support means' removing the skis from said first support means upon reaching a position where the skier will leave the ski lift chair; and placing the ski support means in a receptacle cooperative with the body of the skier for storage during skiing.

* * * * *